US010343178B2

(12) United States Patent
Kishimoto et al.

(10) Patent No.: US 10,343,178 B2
(45) Date of Patent: Jul. 9, 2019

(54) ROTARY ATOMIZING COATING DEVICE AND SPRAY HEAD

(71) Applicant: HONDA MOTOR CO., LTD., Tokyo (JP)

(72) Inventors: Naoki Kishimoto, Tochigi (JP); Takayuki Ueki, Tochigi (JP); Koji Ikeda, Tochigi (JP); Masashi Takebe, Tochigi (JP); Junichi Fukuno, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/114,029

(22) PCT Filed: Nov. 26, 2014

(86) PCT No.: PCT/JP2014/081200
§ 371 (c)(1),
(2) Date: Jul. 25, 2016

(87) PCT Pub. No.: WO2015/114924
PCT Pub. Date: Aug. 6, 2015

(65) Prior Publication Data

US 2016/0339459 A1 Nov. 24, 2016

(30) Foreign Application Priority Data

Jan. 29, 2014 (JP) ..... 2014-014816

(51) Int. Cl.
*B05B 3/10* (2006.01)
*B05B 5/04* (2006.01)

(52) U.S. Cl.
CPC ..... *B05B 3/1014* (2013.01); *B05B 3/1035* (2013.01); *B05B 3/1042* (2013.01); *B05B 3/1064* (2013.01); *B05B 5/0407* (2013.01)

(58) Field of Classification Search
CPC ... B05B 3/1014; B05B 15/065; B05B 5/0407; B05B 3/1064; B05B 3/1042; B05B 3/1035
(Continued)

(56) References Cited

U.S. PATENT DOCUMENTS 2,809,902 A * 10/1957 Ransburg ..... B05B 5/04 118/315
3,000,574 A * 9/1961 Sedlacsik ..... B05B 3/1064 118/626
(Continued)

FOREIGN PATENT DOCUMENTS

JP 53-147740 12/1978
JP 07-213991 8/1995
(Continued)

OTHER PUBLICATIONS

Japanese Office Action dated Aug. 15, 2017, 2 pages.
International Search Report, dated Feb. 10, 2015 (Feb. 10, 2015).

*Primary Examiner* — Arthur O. Hall
*Assistant Examiner* — Joseph A Greenlund
(74) *Attorney, Agent, or Firm* — Rankin, Hill & Clark LLP

(57) ABSTRACT

The rotary atomizing coating device (1) is provided with a spray head (2) formed of a tube body having a circular truncated conical shape and constituted to spray, from an opening end on the large diameter side, a coating introduced from an opening end on the small diameter side thereof, and a coating supply machine (3) engaged with the spray head (2) for supplying the coating while rotating the spray head (2) around an axial line (O). The spray head (2) has a first coating diffusion part (28) having a curved surface with a convex shape towards the axial line (O) on the inner peripheral surface, and a second coating diffusion part (29) extending to an outer edge (26) of the opening end on the
(Continued)

large diameter side having a curved surface with a concave shape towards the axial line (O) with grooves (4) on the outer edge (26).

6 Claims, 2 Drawing Sheets

(58) Field of Classification Search
USPC ..... 239/703, 223, 224
See application file for complete search history.

(56) References Cited

U.S. PATENT DOCUMENTS 4,148,932 A * 4/1979 Tada ..... B05B 5/0407 239/3
4,369,924 A * 1/1983 Morishita ..... B05B 5/0407 239/223
4,458,844 A * 7/1984 Mitsui ..... B05B 5/0407 239/222.11
4,505,430 A * 3/1985 Rodgers ..... B05B 15/55 239/112
4,519,549 A * 5/1985 Yokoe ..... B05B 5/0407 118/626
4,589,597 A * 5/1986 Robisch ..... B05B 3/1064 239/224
4,601,921 A * 7/1986 Lee ..... B05B 5/0407 118/300
4,643,357 A * 2/1987 Culbertson ..... B05B 3/1014 239/112
4,776,520 A * 10/1988 Merritt ..... B05B 3/1064 239/214
4,785,995 A * 11/1988 Yamane ..... B05B 3/1057 118/626
4,919,333 A * 4/1990 Weinstein ..... B05B 3/1064 239/223
4,943,005 A * 7/1990 Weinstein ..... B05B 3/1064 239/223
5,820,036 A * 10/1998 Saito ..... B05B 3/1064 239/703
5,909,849 A * 6/1999 Yamasaki ..... B05B 3/1014 239/224
5,934,574 A * 8/1999 van der Steur ..... B05B 5/0407 239/504
6,056,215 A * 5/2000 Hansinger ..... B05B 3/1064 239/703
6,189,804 B1 * 2/2001 Vetter ..... B05B 3/1014 239/223
6,341,734 B1 * 1/2002 Van Der Steur ..... B05B 3/1014 239/223
6,659,367 B2 * 12/2003 Ballu ..... B05B 3/1064 239/223
6,896,211 B2 * 5/2005 Seitz ..... B05B 3/1042 239/700
7,041,173 B2 * 5/2006 Merabet ..... B05B 3/1014 118/300
7,861,945 B2 * 1/2011 Yasuda ..... B05B 3/1014 239/112
7,959,092 B2 * 6/2011 Nomura ..... B05B 3/1014 239/222.11
8,333,334 B1 * 12/2012 Gefert ..... B05B 5/0407 239/223
8,590,807 B2 * 11/2013 Callendret ..... B05B 3/1092 239/223
8,690,076 B2 * 4/2014 Yamasaki ..... B05B 3/1014 239/223
8,720,797 B2 * 5/2014 Yamasaki ..... B05B 3/1014 239/214
8,840,043 B2 * 9/2014 Nakazono ..... B05B 3/1014 239/243
8,851,397 B1 * 10/2014 van der Steur ..... B05B 3/1064 239/112
8,905,324 B2 * 12/2014 Ballu ..... B05B 3/1014 118/300
8,905,325 B2 * 12/2014 Ballu ..... B05B 3/1057 239/224
9,375,734 B1 * 6/2016 van der Steur ..... B05B 3/1092
2003/0010841 A1 * 1/2003 Kon ..... B05B 3/1064 239/224
2007/0290081 A1 * 12/2007 Murai ..... B05B 3/1014 239/703
2010/0307408 A1 * 12/2010 Kishimoto ..... B05B 3/1014 118/300
2012/0187220 A1 * 7/2012 Micheli ..... B05B 7/067 239/461
2015/0273497 A1 * 10/2015 Mitomo ..... B05B 5/0407 239/223
2016/0193616 A1 * 7/2016 Reichler ..... B05B 3/1014 239/224
2016/0339459 A1 * 11/2016 Kishimoto ..... B05B 3/1014

FOREIGN PATENT DOCUMENTS

JP 09-234393 9/1997
JP 10-052657 2/1998
JP 2005-118710 5/2005
JP 2006-181556 7/2006

* cited by examiner

ROTARY ATOMIZING COATING DEVICE AND SPRAY HEAD

TECHNICAL FIELD

The present invention relates to a rotary atomizing coating device and a spray head used therein.

BACKGROUND ART

Conventionally, there has been proposed a rotary atomizing coating device which delivers the coating supplied from a coating machine through a coating outlet hole provided at a hub member by using the centrifugal force of the rotation, to a coating diffusion surface which is provided at an inner periphery of a head body and configured by a curved surface with a concave shape towards the rotation axial line, and which atomizes the coating near the outer edge of the coating diffusion surface to spray towards an object to be coated (refer to Patent Literature 1).

In this device, since the coating diffusion surface is configured by a curved surface having a concave shape towards the rotation axial line, it is able to quickly supply the liquid film of the coating to the outer edge of the coating diffusion surface.

However, since the coating moving in the same radial direction has a tendency of decreasing the moving acceleration as moving towards the outer edge of the coating diffusion surface, there are cases where the liquid film of the coating becomes thicker at the coating diffusion surface configured by the curved surface with the concave shape compared to a coating diffusion surface configured by a curved surface with a convex shape which is described later. The reason for this can be understood from the fact that when the centrifugal force is indicated as F, and the angle between the rotation axial line and the direction along the curved surface with the concave shape is indicated as $\theta$, the component force of the centrifugal force in the direction along the curved surface with the concave shape expressed by $F\sin\theta$ becomes smaller towards the outer edge of the coating diffusion surface, and in the contrary, the component force of the centrifugal force in a direction vertical to the direction along the curved surface with the concave shape expressed by $F\cos\theta$ becomes larger towards the outer edge of the coating diffusion surface.

As a result, there is a possibility that the liquid film of the coating which has become thick in the vicinity of the outer edge of the coating diffusion surface overflows from the groove formed in the vicinity of the outer edge of the coating diffusion surface, and there is a concern that the overflowed coating is sprayed while not being formed as liquid threads. Moreover, in a case where the liquid film of the coating becomes very thick, there is a possibility that it separates from the curved surface with the concave shape before reaching the vicinity of the outer edge of the coating diffusion surface, thereby causing defects in the appearance of the coating object.

Moreover, there has been proposed a rotational atomization electrostatic coating apparatus in which a coating supplied from the coating nozzle is delivered through a coating outlet hole to a coating diffusion surface which is configured by a curved surface with a convex shape towards a rotation axial line and provided at the inner periphery of a spray head, and the coating is atomized in the vicinity of the outer edge of the coating diffusion surface to be sprayed towards the coating object (refer to Patent Literature 2).

In such apparatus, since the coating diffusion surface is configured by a curved surface with a convex shape towards the rotation axial line, the liquid film of the coating becomes thinner towards the outer edge of the coating diffusion surface. Therefore, the inconvenience of the liquid film becoming thick can be avoided.

However, since there is a tendency that the acceleration of the coating becomes larger towards the outer edge of the coating diffusion surface, the moving speed of the coating becomes too fast in the vicinity of the outer edge of the coating diffusion surface that the coating does not enter the grooves formed in the vicinity of the outer edge of the coating diffusion surface, thereby being sprayed without being formed as liquid threads,

CITATION LIST

Patent Literature

Patent Literature 1: Japanese Patent Application Laid-open No. 2005-118710

Patent Literature 2: Japanese Patent Application Laid-open No, 1-110-52657

SUMMARY OF INVENTION

Problem to be Solved by the Invention

The present invention has been made in view of the above situation, and it is an object of the present invention to provide a rotary atomizing coating device which realizes both of the formation of thin film and liquid threads of the coating, and a spray head used therein.

Solution to the Problem

A rotary atomizing coating device of the present invention comprise a spray head formed of a tube body having a circular truncated conical shape and configured so as to spray, from an opening end on a large diameter side, a coating introduced from an opening end on a small diameter side thereof, and a coating supply machine engaged with the opening end on the small diameter side of the spray head for supplying the coating to inside of the spray head while rotating the spray head around an axial line of the tube body, wherein the spray head includes a first coating diffusion part configured by a curved surface with a convex shape towards the axial line of the tube body on an inside peripheral surface, and a second coating diffusion part extending from the first coating diffusion part to an outer edge of the opening end on the large diameter side of the tube body and configured by a curved surface with a concave shape towards the axial line, and wherein the second coating diffusion part has grooves provided at the outer edge.

According to the rotary atomizing coating device of the present invention, the first coating diffusion part is configured by a curved surface with a convex shape towards the axial line and since the component force of the centrifugal force in the direction along the curved surface with the convex shape becomes larger towards the outer edge, the moving speed of the coating liquid film becomes faster, thereby forming the coating as a thin film. Moreover, since the second coating diffusion part is configured by a curved surface with a concave shape towards the axial line extending to the outer edge which is located closest to the coating object side, the component force of the centrifugal force in the direction vertical to the direction along the curved surface with the concave shape becomes larger towards the outer edge, and the coating which has been formed as a thin film is surely guided to the grooves of the second coating diffusion part in the vicinity of the outer edge, thereby realizing to form liquid threads of the coating.

In the rotary atomizing coating device of the present invention, it is preferable that the spray head includes an inclined surface provided closer to the small diameter side of the tube body than the first coating diffusion part, and an angle between the axial line being 45° or less. According to this configuration, since the component force of the centrifugal force in a direction pushing the coating to the inclined surface becomes large, the coating supplied radially with respect to the inclined surface can be expanded to the whole inclined surface.

The spray head of the present invention is formed of a tube body having a circular truncated conical shape and configured so as to spray, from an opening end on a large diameter side, a coating introduced from an opening end on a small diameter side thereof The spray head is characterized in having a first coating diffusion part configured by a curved surface with a convex shape towards an axial line of the tube body at an inner peripheral surface, and a second coating diffusion part extending from the first coating diffusion part to an outer edge of the opening end on the large diameter side of the tube body and configured by a curved surface with a concave shape towards the axial line, and the second coating diffusion part has grooves provided at the outer edge.

According to the spray head of the present invention, the first coating diffusion on part is configured by a curved surface with a convex shape towards the axial line and since the component force of the centrifugal force in the direction along the curved surface with the convex shape becomes larger towards the outer edge, the moving speed of the coating liquid film becomes faster, thereby forming the coating as a thin film. Moreover, since the second coating diffusion part is configured by a curved surface with a concave shape towards the axial line and extends to the outer edge of the opening end of the large diameter side of the tube body, the component force of the centrifugal force in the direction vertical to the direction along the curved surface with the concave shape becomes larger towards the outer edge, and the coating which has been formed as a thin film is surely guided to the grooves of the second coating diffusion part in the vicinity of the outer edge, thereby realizing to form liquid threads of the coating.

DESCRIPTION OF EMBODIMENTS

Figure 1:
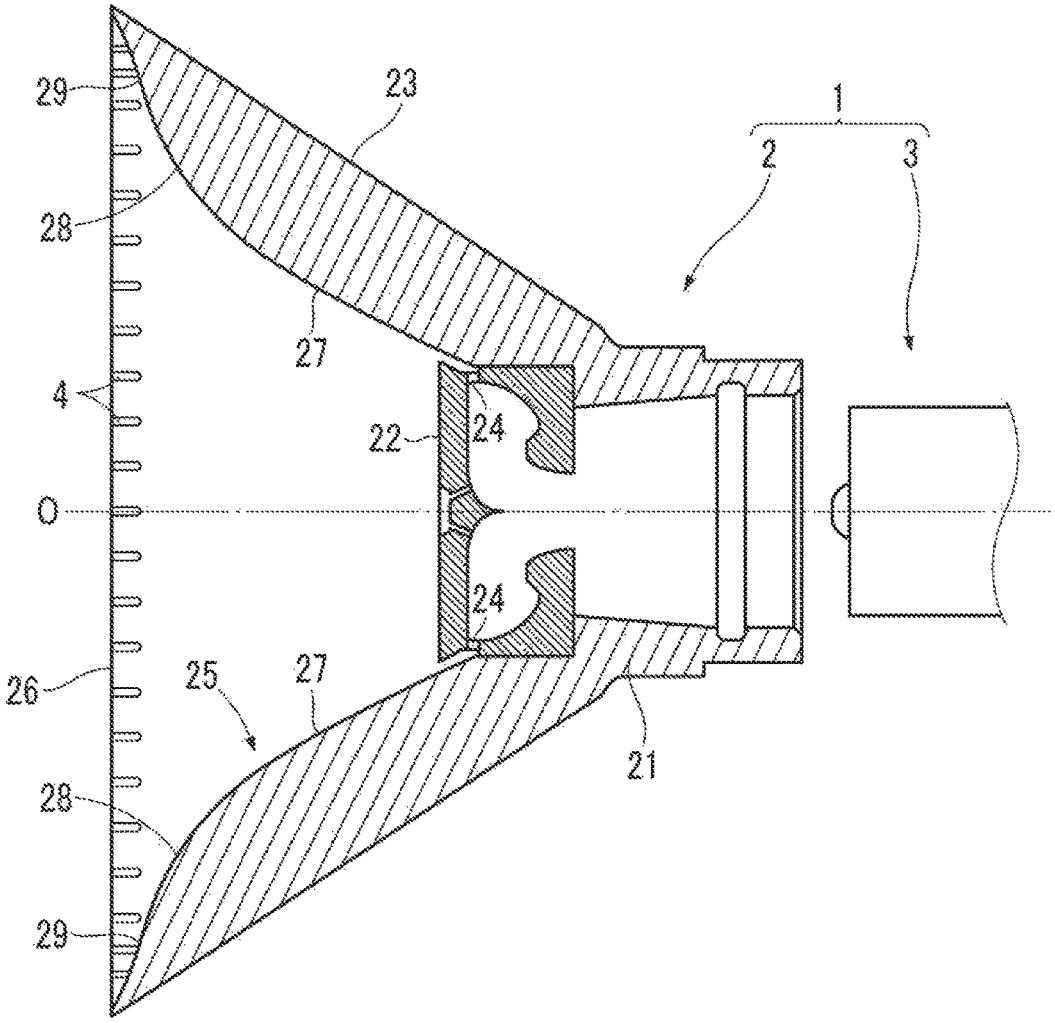
FIG. 1 is a cross-sectional view illustrating a rotary atomizing coating device according to an embodiment of the present invention.

As illustrated in FIG. 1, for example, a rotary atomizing coating device 1 related to an embodiment of the present invention used for coating of a vehicle body of a vehicle or the like has a spray head 2 formed of a tube body having a circular truncated conical shape and having a circular cross section with an axial line O as the center, and a coating supply machine 3 engaged with an opening end on a side of the spray head 2 in which the diameter of a circular cross section vertical to the center axial line O is small (the right side in FIG. 1, hereinafter referred to as the small diameter side) and which supplies the coating to an inside of the spray head 2 while rotating the spray head 2 around the axial line of the tube body.

The spray head 2 is composed of a coating supply machine attaching part 21 having an inner diameter which decreases from the small diameter side of the spray head 2 towards a side in which the diameter of the circular cross section vertical to the center axial line O is large (the left side in FIG. 1, hereinafter referred to as the large diameter side), a hub part 22 arranged inside thereof at the large diameter side, and a cup shaped part 23 having an inner diameter which enlarges from the coating supply machine attaching part 21 to the large diameter side.

The coating supply machine attaching part 21 is formed as a hollow cylindrical shape, and is attached to the coating supply machine 3 by engaging with a rotation driving part of the coating supply machine 3 at an opening end thereof.

The hub part 22 is provided at the small diameter side of the cup shaped part 23. The inside of the coating supply machine attaching part 21 and the inside of the cup shaped part 23 are separated by interposing the hub part 22 therebetween. Moreover, the hub part 22 includes a coating outlet hole 24 which communicates between the inside of the coating supply machine attaching part 21 and the inside of the cup shaped part 23. Here, the coating supplied from the coating supply machine 3 to the inside of the spray head 2 is delivered to the coating diffusion part 25 described later by passing through the coating outlet hole 24.

The cup shaped part 23 has a hollow circular truncated conical shape with a diameter enlarging from the small diameter side to the large diameter side of the tube body, and includes an outer edge 26 at the opening end of the large diameter side and the coating diffusion part 25 provided at the inner peripheral surface thereof.

Figure 2:
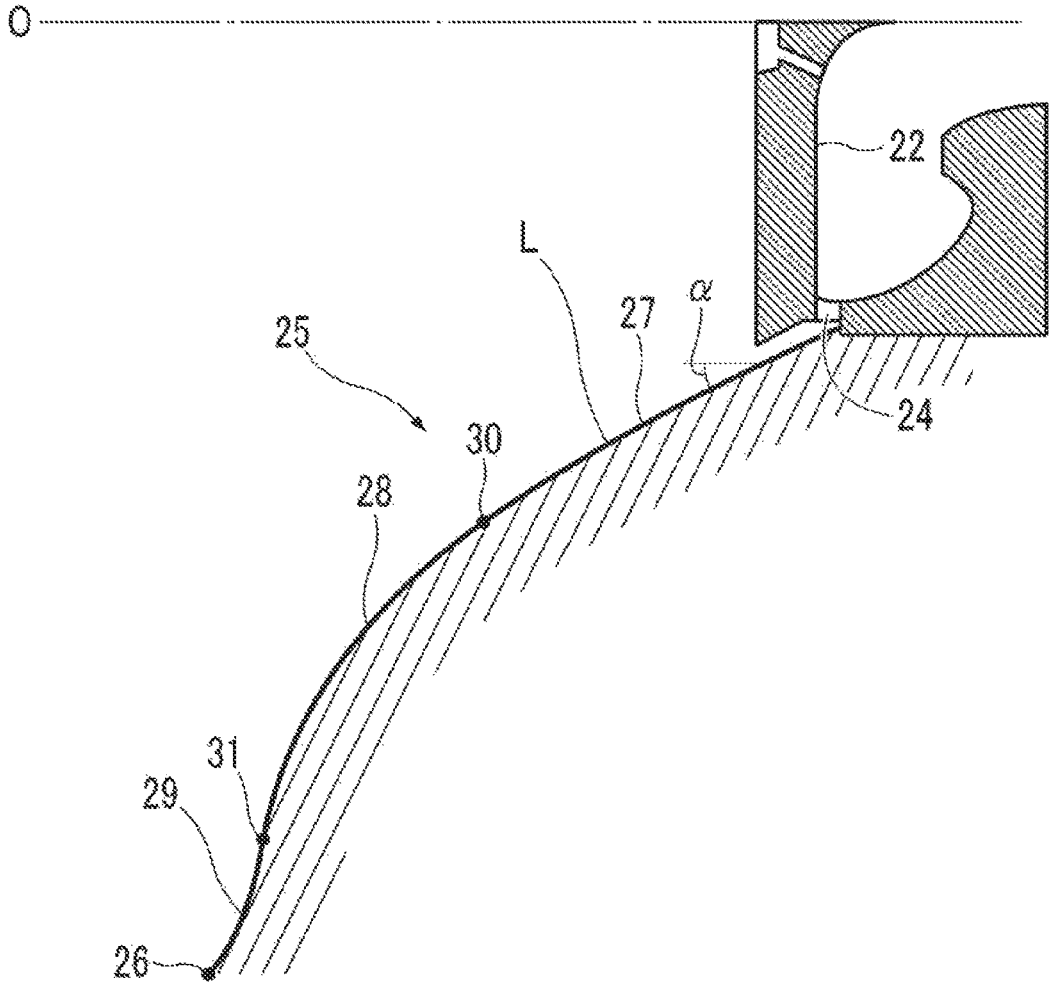
FIG. 2 is a cross-sectional view illustrating an enlarged coating diffusion part of a spray head.

As illustrated in FIG. 2, the coating diffusion part 25 is composed of a tapered part 27, a first coating diffusion part 28, and a second coating diffusion part 29 in this order from the small diameter side towards the large diameter side of the tube body.

The tapered part 27 is formed of an inclined surface. The end part of the tapered part 27 at the small diameter side is formed so as to engage with the hub part 22.

According to the above configuration, the coating supplied inside the spray head 2 from the coating supply machine 3 passes through the coating outlet hole 24 and reaches the tapered part 27, in details, observing from the opening surface of the large diameter side of the spray head 2, the coating is discharged from a plurality of coating outlet holes 24 formed along the circumferential part of the hub part 22 with an interval therebetween, and is radially supplied with respect to the tapered part 27. The angle a between the inclined surface of the tapered part 27 and the axial line O is equal to or less than 45°. According to this configuration, since the component force of the centrifugal force in the direction which pushes the coating to the tapered part 27 becomes large, it is possible to press and expand the coating supplied radially to the tapered part 27 to the whole surface of the tapered part 27.

The first coating diffusion part 28 is configured by a curved surface with a convex shape having a predetermined curvature radius towards the axial line O. The first coating diffusion part 28 and the tapered part 27 are connected at a boundary 30 (indicated by a point on a cross sectional shape line L in FIG. 2). The inclined surface of the tapered part 27 is expressed by a tangential line passing the boundary 30 of the curved surface with the convex shape of the first coating diffusion part 28. The tapered part 27 and the first coating diffusion part 28 are smoothly connected.

Here, the first coating diffusion part 28 may be configured by a convex surface of an arched cross section having a constant curvature radius towards the axial line O. in this case, the curvature center of the arc shape convex surface is at the inner side of the convex surface.

The second coating diffusion part 29 extends to the outer edge 26 and is configured by a curved surface with a concave shape having a predetermined curvature radius towards the axial line O. The first coating diffusion part 28 and the second coating diffusion part 29 are connected at a boundary 31 (indicated by a point on the cross sectional shape line L in FIG, 2). The tangential line of the curved surface with the convex shape matches the tangential line of the curved surface of the concave shape passing this boundary 31. Accordingly, the first coating diffusion part 28 and the second coating diffusion part 29 are smoothly connected.

Here, the second coating diffusion part 29 may be configured by a concave surface of an arched cross section having a constant curvature radius towards the axial line O. In this case, the curvature center of the arc shape concave surface is at the inner side of the concave surface. It is preferable that the length of the second coating diffusion part 29 in the axial line O direction is shorter than the length of the first coating diffusion part 28 in the axial line O direction.

Moreover, the second coating diffusion part 29 includes a plurality of grooves 4 which are concaved in the radius direction of a circle having the axial line O of the opening end as the center and extending inwardly from the outer edge 26 of the opening end of the cup shaped part 23 along the direction of the axial line O. The plurality of grooves 4 are provided intermittently along the circumference of the circle having the axial line O as the center so as to form the thin filmed coating as liquid threads. Each groove 4 may be formed so that the rear end positioned inside the cup shaped part 23 is arranged at the first coating diffusion part 28. Moreover, the extending direction of each groove 4 is not limited to a parallel direction with respect to the axial line O as illustrated in FIG. 1, and may be in a direction inclined with respect to the axial line O.

As such, the coating diffusion part 25 has a hollow circular truncated conical shape as illustrated in FIG. 2, and allows to surely flow the thin filmed coating into the grooves 4 at the vicinity of the outer edge 26, thereby enabling to form the liquid threads. Therefore, even if the supplied amount of the coating increases, the coating does not overflow from the grooves 4, and the coating can be surely formed as liquid threads. Accordingly, this configuration is especially suitable to be used for coating which requires large discharge.

In details, since the first coating diffusion part 28 is configured by the curved surface with the convex shape towards the axial line O, and the component force of the centrifugal force in the direction along the curved surface with the convex shape becomes larger towards the outer edge 26, the moving speed of the coating liquid film increases so as to form the coating as a thin film. Moreover, since the second coating diffusion part 29 extends to the outer edge 26 and is configured as the curved surface with the concave shape towards the axial line O, the component force of the centrifugal force in a direction vertical to the direction along the curved surface with the concave shape becomes larger towards the outer edge 26, the thin filmed coating is surely introduced to the grooves 4 of the second coating diffusion part 29 at the vicinity of the outer edge 26, and the formation of liquid threads of the coating is realized. Then, the coating is sprayed outside from the opening end formed at the outer edge 26 of the coating diffusion part 25.

According to the above embodiment, both of the formation of thin film and liquid threads of the coating can be realized.

In the above embodiment, the coating diffusion part 25 is composed of the tapered part 27, the first coating diffusion part 28, and the second coating diffusion part 29. However, the present invention is not limited to this. For example, the coating diffusion part 25 may be composed of the first coating diffusion part 28, and the second coating diffusion part 29 provided at the large diameter side of the spray head 2 with respect to the first coating diffusion part 28. In such case, the coating supplied from the coating supply machine 3 passes through the coating outlet hole 24 and directly reaches the first coating diffusion part 28.

REFERENCE SIGNS LIST

1 . . . rotary atomizing coating device, 2 . . . spray head, 3 . . . coating supply machine, 4 . . . groove, 21 . . . coating supply machine attaching part, 22 . . . hub part, 23 . . . cup shaped part, 24 . . . coating outlet hole, 25 . . . coating diffusion part, 26 . . . outer edge, 27 . . . tapered part, 28 . . . first coating diffusion part, 29 . . . second coating diffusion part, 30 . . . boundary between the first coating diffusion part and the tapered part, 31 . . . boundary between the first coating diffusion part and the second coating diffusion part, O . . . axial line

The invention claimed is:

1. A rotary atomizing coating device comprising a spray head formed of a tube body having a circular truncated conical shape and configured so as to spray, from an opening end on a large diameter side, a coating introduced from an opening end on a small diameter side thereof, and a coating supply machine engaged with the opening end on the small diameter side of the spray head for supplying the coating to inside of the spray head while rotating the spray head around an axial line of the tube body, wherein the spray head includes a first coating diffusion part configured by a curved surface with a convex shape towards the axial line of the tube body on an inner peripheral surface, a second coating diffusion part extending from the first coating diffusion part to an outer edge of the opening end on the large diameter side of the tube body and configured by a curved surface with a concave shape towards the axial line, and a tapered part provided at the small diameter side of the tube body relative to the first coating diffusion part, wherein the second coating diffusion part has grooves provided at the outer edge, a hub part is provided inside the spray head, the hub part includes a projection end part which projects to an inner side of the tapered part in a radial direction of the tube body, a taper angle between the tapered part and the axial line is 45° or less, and the taper angle between the tapered part and the axial line is constant along an entirety of the tapered part, the projection end part is provided with a coating outlet hole which is open to an outer periphery of the projection end part, formed continuously with the tapered part, and provides the coating supplied from the coating supply machine to the tapered part, the tapered part terminates at a location of the hub part while maintaining the taper angle, the location of the hub part being on the small diameter side relative to the coating outlet hole, the outer periphery of the projection end part extends along the tapered part, and the coating outlet hole discharges the coating to the tapered part.

2. The rotary atomizing coating device according to claim 1, wherein a boundary of the first coating diffusion part and the tapered part is positioned closer to the opening end of the large diameter side of the tube body than the hub part in a direction of the axial line of the tube body, and an inclined line of the tapered part in a cross section of the inner peripheral surface of the spray head passing through the axial line is expressed by a tangential line of the first coating diffusion part at the boundary of the cross section.

3. The rotary atomizing coating device according to claim 1, wherein the coating outlet hole discharges the coating directly to the tapered part.

4. The rotary atomizing coating device according to claim 1, wherein an angle of the outer periphery of the projection end part of the hub part with respect to the axial line is 45° or less.

5. The rotary atomizing coating device according to claim 1, wherein the outer periphery of the projection end part is parallel to the taper angle of the tapered part.

6. A rotary atomizing coating device comprising a spray head formed of a tube body having a circular truncated conical shape and configured so as to spray, from an opening end on a large diameter side, a coating introduced from an opening end on a small diameter side thereof, and a coating supply machine engaged with the opening end on the small diameter side of the spray head for supplying the coating to inside of the spray head while rotating the spray head around an axial line of the tube body, wherein the spray head includes a first coating diffusion part configured by a curved surface with a convex shape towards the axial line of the tube body on an inner peripheral surface, a second coating diffusion part extending from the first coating diffusion part to an outer edge of the opening end on the large diameter side of the tube body and configured by a curved surface with a concave shape towards the axial line, and a tapered part provided at the small diameter side of the tube body relative to the first coating diffusion part, wherein the second coating diffusion part has grooves provided at the outer edge, a hub part is provided inside the spray head, the hub part includes a projection end part which projects to an inner side of the tapered part in a radial direction of the tube body, a taper angle between the tapered part and the axial line is 45° or less, and the taper angle between the tapered part and the axial line is constant along an entirety of the tapered part, the projection end part is provided with a coating outlet hole which is open to an outer periphery of the projection end part, formed continuously with the tapered part, and provides the coating supplied from the coating supply machine to the tapered part, the outer periphery of the projection end part extends along the tapered part and is parallel to the taper angle of the tapered part, the coating outlet hole discharges the coating to the tapered part.

* * * * *